US009199445B2

(12) United States Patent
Vilà et al.

(10) Patent No.: US 9,199,445 B2
(45) Date of Patent: Dec. 1, 2015

(54) PRINTING MACHINE HAVING A CENTRAL IMPRESSION DRUM

(71) Applicant: Comexi Group Industries, S.A.U., Riudellots de la Selva, (Girona) (ES)

(72) Inventors: Jordi Puig Vilà, Bescanó (ES); Carles Fortià, Girona (ES)

(73) Assignee: COMEXI GROUP INDUSTRIES, S.A.U. (ES)

( * ) Notice: Subject to any disclaimer, the term of this patent is extended or adjusted under 35 U.S.C. 154(b) by 0 days.

(21) Appl. No.: 14/503,457

(22) Filed: Oct. 1, 2014

(65) Prior Publication Data

US 2015/0096452 A1 Apr. 9, 2015

(30) Foreign Application Priority Data

Oct. 7, 2013 (EP) ..... 13380044

(51) Int. Cl.

| | |
|---|---|
| ***B41F 23/04*** | (2006.01) |
| ***B41F 5/24*** | (2006.01) |
| ***B41F 9/00*** | (2006.01) |
| ***B41F 9/06*** | (2006.01) |
| ***B41F 13/18*** | (2006.01) |
| ***B41F 23/00*** | (2006.01) |

(52) U.S. Cl.

CPC ..... *B41F 23/0426* (2013.01); *B41F 5/24* (2013.01); *B41F 9/003* (2013.01); *B41F 9/063* (2013.01); *B41F 13/18* (2013.01); *B41F 23/00* (2013.01); *B41F 23/04* (2013.01); *B41F 23/042* (2013.01); *B41F 23/043* (2013.01); *B41F 23/0403* (2013.01); *B41F 23/0406* (2013.01); *B41F 23/0409* (2013.01); *B41F 23/0413* (2013.01); *B41F 23/0416* (2013.01); *B41F 23/0423* (2013.01); *B41P 2200/12* (2013.01)

(58) Field of Classification Search

CPC ..... B41F 23/0403; B41F 23/0406; B41F 23/0409; B41F 23/0413; B41F 23/0423; B41F 23/0426; B41F 23/043; B41F 23/0433; B41F 23/0436; B41F 23/04; B41F 7/10; B41F 5/18; B41M 7/009; B41M 5/0011; B41M 7/0081; B41M 7/0054; B41M 7/0045

See application file for complete search history.

(56) References Cited

U.S. PATENT DOCUMENTS 3,528,620 A 9/1970 Roscoe
6,598,531 B2 * 7/2003 Nedblake et al. ..... 101/490

FOREIGN PATENT DOCUMENTS

EP 2857198 A1 * 4/2015 ..... B41F 23/04

OTHER PUBLICATIONS

U.S. Appl. No. 14/503,817, Jordi Puig Villa et al.

*Primary Examiner* — Blake A Tankersley
*Assistant Examiner* — Ruben Parco, Jr.
(74) *Attorney, Agent, or Firm* — Hess Patent Law Firm LLC; Robert J. Hess

(57) ABSTRACT

The printing machine (50) comprises a central impression drum (35) supporting a web substrate (S), several printing groups (51-55) arranged around an entry side (35*a*) and several printing groups (56-60) arranged around an exit side (35*b*) of the central impression drum for applying water-based inks or solvent-based inks on the web substrate (S), and at least one drying unit (61-69) arranged between each pair of adjacent printing groups. The first drying unit located in a larger space between the first printing group (51) and the subsequent printing group (53) and/or the last drying unit located in a larger space between the last printing group (60) and the preceding printing group (58) is an extensive drying unit (61, 69) providing an exposure time to a drying agent longer than the remaining drying units.

13 Claims, 3 Drawing Sheets

PRINTING MACHINE HAVING A CENTRAL IMPRESSION DRUM

TECHNICAL FIELD

The present invention generally relates to a printing machine having a central impression drum, and more particularly to a printing machine having several printing groups arranged around a central impression drum for applying water-based inks or solvent-based inks on a web substrate supported on the central impression drum, and at least one drying unit arranged between each pair of adjacent printing groups, where the drying unit located between the first printing group and a subsequent printing group and/or the drying unit located between the last printing group and a preceding printing group are extensive drying units.

BACKGROUND OF THE INVENTION

Printing machines are known, such as for example the one described in document U.S. Pat. No. 3,528,620 A, having a rotary central impression drum provided with an outer surface suitable for supporting a web substrate between a substrate entry point located on an entry side of said central impression drum and a substrate exit point located on an exit side of the central impression drum. A plurality of printing groups are uniformly distributed along each of said entry and exit sides of the central impression drum, and each printing group has a printing cylinder depositing a respective water-based ink or solvent-based ink at a specific impression point on said web substrate supported on said central impression drum.

In these known printing machines, between each pair of adjacent printing groups there is arranged at least one drying unit configured for applying a drying agent, such as a drying air stream or infrared radiation, to the web substrate supported on the central impression drum and thereby drying by evaporating the water or solvent the ink deposited on the web substrate by the preceding printing group sufficiently to allow depositing the subsequent ink thereon without causing the inks to run, all the drying units being similar or having comparable dimensions. After the last printing group and the substrate exit point, with respect to the forward movement direction of the web substrate, there is arranged a final drying unit generally in the form of a drying tunnel applying a drying agent to the web substrate for final drying of all the inks deposited thereon.

Throughout this description, the term "ink" is generically used to designate inks, varnishes, adhesives, coatings and other water- or solvent-based compounds that can be applied to a substrate by means of a printing machine.

In known printing machines of the type described above, a problem arises when the first ink applied by the first printing group, with respect to the forward movement direction of the web substrate, is a base ink having a relatively high viscosity, generally white in color, applied as a relatively thick layer completely covering the surface of the web substrate or a significantly large area thereof, on which the rest of the inks will be successively applied, because the drying agent applied by the first drying unit in combination with a high speed of movement of the web substrate is insufficient to perform a drying or even a partial drying of said base ink which would allow the subsequent ink to be applied on the base ink without causing the inks to run.

A similar problem occurs when the ink applied by the last printing group is a transparent coating varnish or ink, generally having a shiny finish, applied as a layer completely covering the surface of the web substrate or a significantly large area thereof over the previously deposited inks, because the drying agent applied successively by all the drying units in combination with a high speed of movement of the web substrate is insufficient for partially drying the superimposed inks which would allow the subsequent application of the coating varnish or ink without causing the inks to run.

Conventional drying units commonly use a drying air stream as a drying agent, and comprise at least one air nozzle blowing drying air supplied from a drying air supply device, which generally includes an air supply turbine, and optionally a heater and a dehumidifier. Nevertheless, it has been found that even by increasing the temperature at which the drying air is heated and/or reducing the humidity of the drying air and/or increasing the flow rate at which the drying air is supplied to the drying units, conventional drying units do not provide sufficient drying to allow using a base ink applied by the first printing group and/or using a coating varnish or ink applied by the last printing group without the problems of inks running.

Printing machines are also known which use infrared radiation as a drying agent to evaporate water or solvent from the inks deposited on the web substrate.

An objective of the present invention is to provide a printing machine having a central impression drum provided with at least one extensive drying unit arranged between the first printing group and a subsequent printing group, with respect to the movement direction of the web substrate, which allows using a base ink applied by the first printing group and/or at least one extensive drying unit arranged between the last printing group and a preceding printing group, with respect to the movement direction of the web substrate, which allows using a coating varnish or ink applied by the last printing group.

DISCLOSURE OF THE INVENTION

The present invention contributes to achieving the foregoing and other objectives by providing a printing machine having a central impression drum comprising a rotary central impression drum, which has an outer surface suitable for supporting a web substrate between a substrate entry point located on an entry side of said central impression drum and a substrate exit point located on an exit side of the central impression drum with respect to a vertical plane containing the axis of rotation of the central impression drum.

The printing machine of the present invention further comprises a plurality of printing groups distributed along said entry side and said exit side of the central impression drum. Each printing group has a printing cylinder depositing a respective water-based ink or solvent-based ink at a impression point on said web substrate supported on the central impression drum. Said printing groups include a first printing group and a last printing group, with respect to the forward movement direction of the web substrate. The first printing group is adjacent to said substrate entry point and the last printing group is adjacent to said substrate exit point.

The printing machine of the present invention further comprises a plurality of drying units configured and arranged for applying a drying agent to the web substrate supported on the central impression drum and thereby drying by evaporating the water or solvent the ink deposited on the web substrate. At least one of said drying units is arranged between each pair of adjacent printing groups.

Between the impression point of the first printing group and the impression point of a subsequent printing group and/or between the impression point of the last printing group and the impression point of a preceding printing group, there is an angular distance with respect to the circumference of the central impression drum which is at least two times greater than an angular distance between the impression points of each remaining pair of adjacent printing groups located on said entry side of the central impression drum and than an angular distance between the impression points of each remaining pair of adjacent printing groups located on said exit side of the central impression drum.

In a space provided by said angular distance between the impression point of the first printing group and the impression point of said subsequent printing group and/or between the impression point of the last printing group and the impression point of said preceding printing group, there is installed at least one of the drying units, which is at least one extensive drying unit, dimensioned for providing an exposure time of the web substrate to the drying agent applied by said at least one extensive drying unit at least two times longer, and preferably at least three times longer, than an exposure time of the web substrate to the drying agent applied by each of the remaining drying units.

Thus, the extensive drying unit located between the first printing group and the subsequent printing group allows using a base ink applied by the first printing group without causing the inks to run, and the extensive drying unit located between the last printing group and the preceding printing group allows using a coating varnish or ink applied by the last printing group without causing the inks to run.

In one embodiment, the drying units use drying air as the drying agent, and each drying unit comprises at least one air nozzle blowing drying air supplied from a drying air supply device. The printing machine preferably comprises a final drying unit arranged after the substrate exit point of the central impression drum, with respect to the forward movement direction of the web substrate, and configured for applying a drying agent to the web substrate and thereby performing final drying of all the inks deposited thereon. This final drying unit is preferably a drying tunnel comprising a plurality of air nozzles blowing drying air supplied from said drying air supply device. The drying air supply device includes an air supply turbine and preferably a dehumidifier reducing the humidity of the drying air with respect to the humidity of the ambient air and a heater increasing the temperature of the drying air with respect to the temperature of the ambient air.

In an alternative embodiment, the drying units use infrared radiation as a drying agent, and each drying unit comprises at least one infrared radiation source, and optionally a final drying unit arranged after the substrate exit point of the central impression drum, with respect to the forward movement direction of the web substrate, is provided with a plurality of infrared radiation sources.

The printing groups of the printing machine of the present invention can be flexographic printing groups, rotogravure printing groups, or offset printing groups, or a combination of flexographic printing groups and/or rotogravure printing groups and/or offset printing groups.

BRIEF DESCRIPTION OF THE DRAWINGS

The foregoing and other features and advantages will become more evident from the following detailed description of exemplary embodiments with reference to the accompanying drawings, in which.

DETAILED DESCRIPTION OF EXEMPLARY EMBODIMENTS

Figure 1:
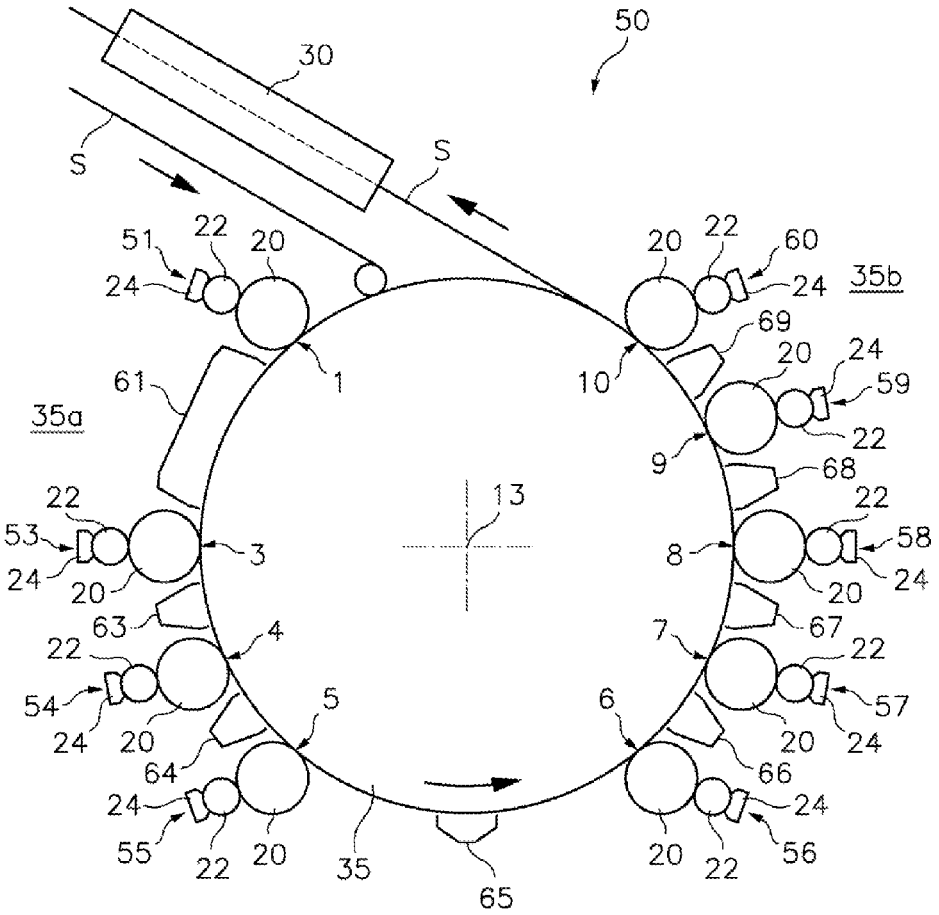
FIG. 1 is a schematic front view of a printing machine having a central impression drum according to a first embodiment of the present invention.

First referring to FIG. 1, reference sign 50 designates a printing machine having a central impression drum according to a first embodiment of the present invention, which comprises a rotary central impression drum 35 rotating about an axis of rotation 13. Said central impression drum 35 has an outer surface suitable for supporting a web substrate S. Guide means guide the web substrate S from an unwinding device (not shown) to the central impression drum 35 and from the central impression drum 35 to a rewinding device (not shown). These guide means provide a substrate entry point 11 located on an entry side 35*a* of the central impression drum 35 and a substrate exit point 12 located on an exit side 35*b* of the central impression drum 35 with respect to a forward movement direction of the web substrate S indicated by means of arrows.

Thus, the web substrate S is supported on the outer surface of the central impression drum 35 from said substrate entry point 11 to said substrate exit point 12 while the central impression drum 35 rotates. The mentioned entry side 35*a* and exit side 35*b* of the central impression drum 35 are demarcated by a vertical geometric plane containing the axis of rotation 13 of the central impression drum.

The printing machine further comprises four printing groups 51, 53, 54, 55 distributed along the entry side 35*a* and other five printing groups 56, 57, 58, 59, 60 distributed along the exit side 35*b* of the central impression drum 35. Each printing group 51, 53, 54, 55, 56, 57, 58, 59, 60 has a printing cylinder 20 depositing a respective water-based ink or solvent-based ink at a corresponding impression point 1, 3, 4, 5, 6, 7, 8, 9, 10 on the web substrate S supported on the central impression drum 35. The mentioned impression points 1, 3, 4, 5, 6, 7, 8, 9, 10 correspond to nip lines between the printing cylinders 20 and the web substrate S supported on the central impression drum 35.

It will be understood that the number of printing groups located on the entry side 35*a* and the number of printing groups located on the exit side 35*b* of the central impression drum 35 is variable, and that printing groups in any number equal to or greater than two is within the scope of the present invention.

The printing groups 51, 53, 54, 55, 56, 57, 58, 59, 60 include a first printing group 51 adjacent to said substrate entry point 11 on the entry side 35*a* and a last printing group 60 adjacent to said substrate exit point 12 on the exit side 35*b*.

Figure 2:
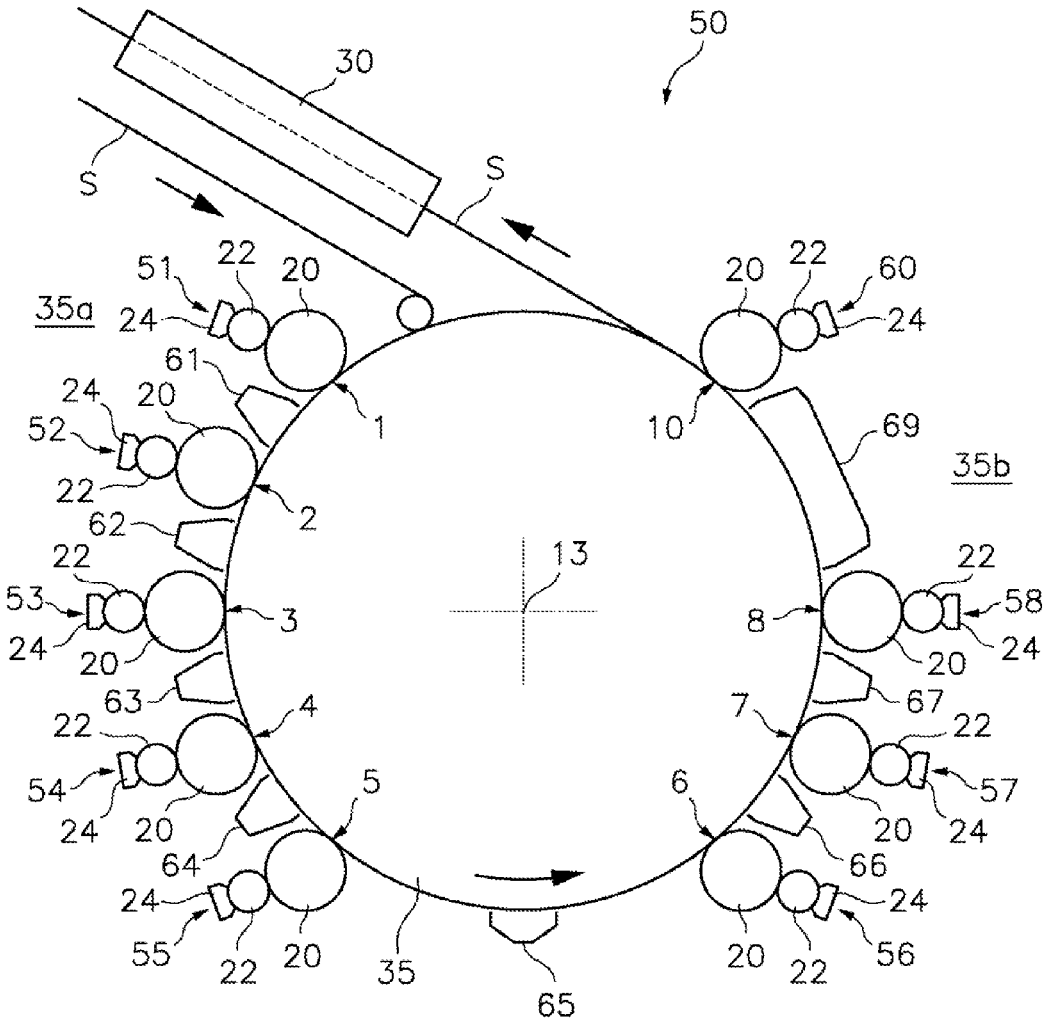
FIG. 2 is a schematic front view of a printing machine having a central impression drum according to a second embodiment of the present invention.
Figure 3:
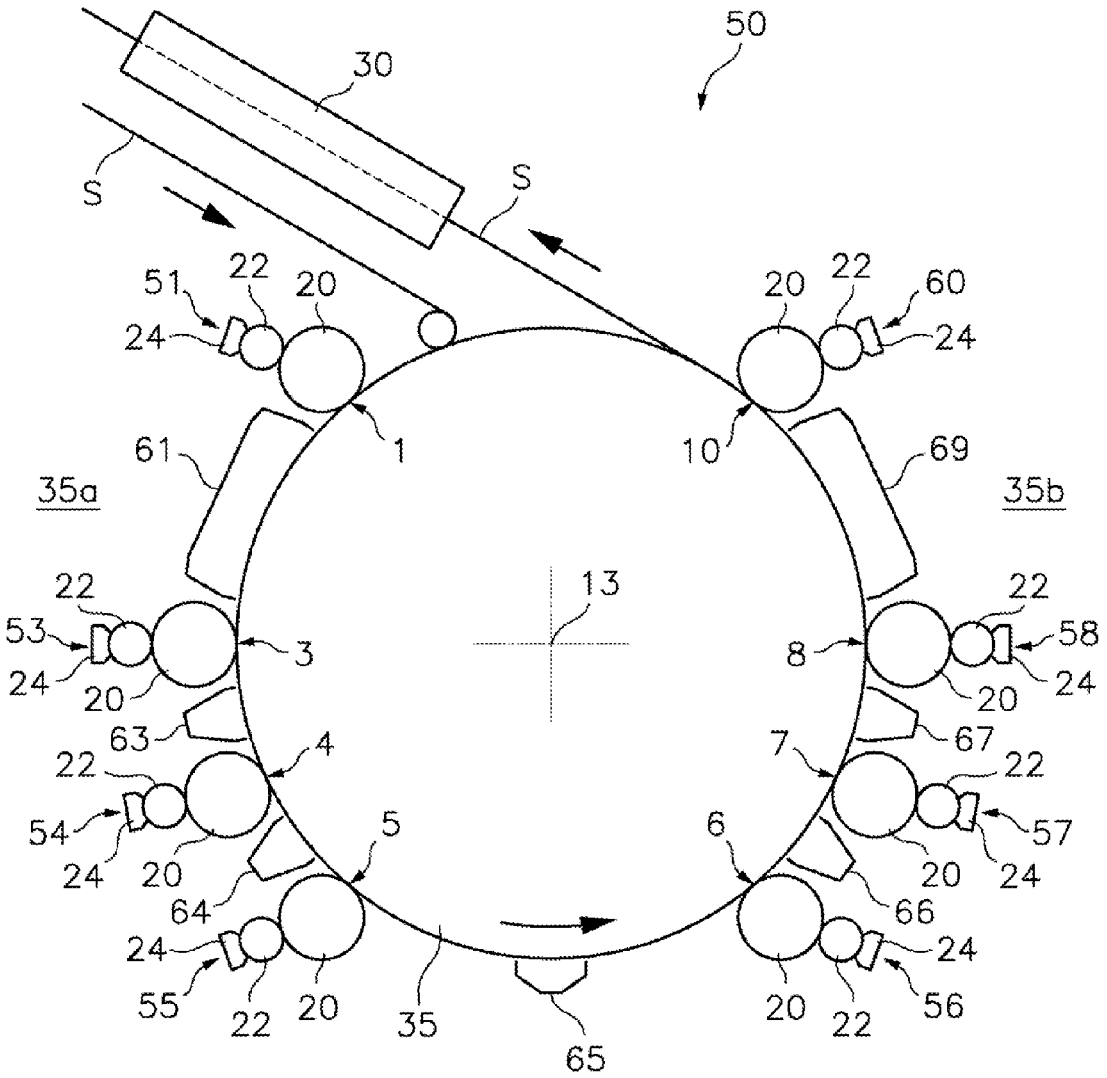
FIG. 3 is a schematic front view of a printing machine having a central impression drum according to a third embodiment of the present invention.

In the embodiments shown in FIGS. 1, 2 and 3, the printing groups are flexographic printing groups in which said printing cylinder 20 is a plate cylinder, which cooperates with an anilox cylinder 22 which in turn cooperates with a conventional inking device 24 having a doctor blade and a closed chamber. Nevertheless, in alternative embodiments the printing groups can be rotogravure printing groups or offset printing groups, or a combination of flexographic printing groups and/or rotogravure printing groups and/or offset printing groups without departing from the scope of the present invention.

Returning to the first embodiment shown in FIG. 1, between each pair of adjacent printing groups 51, 53; 53, 54;

54, 55; 55, 56; 56, 57; 57, 58; 58, 59; 59, 60 there is arranged a drying unit 61, 63, 64, 65, 66, 67, 68, 69 applying a drying agent to the web substrate S supported on the central impression drum 35 for drying the ink deposited on the web substrate S by the preceding printing group by evaporating the water or solvent included in the ink.

Between the impression point 1 corresponding to the first printing group 51 and the impression point 3 corresponding to the subsequent printing group 53, there is an angular distance, with respect to the circumference of the central impression drum 35, which is at least two times greater than the angular distance existing between the impression points 3, 4; 4, 5 corresponding to each remaining pair of adjacent printing groups 53, 54; 54, 55 located on the entry side 35*a* of the central impression drum 35 and than an angular distance between the impression points 6, 7; 7, 8; 8, 9; 9, 10 corresponding to each remaining pair of adjacent printing groups 56, 57; 57, 58; 58, 59; 59, 60 located on the exit side 35*b* of the central impression drum 35.

The mentioned angular distance between the impression point 1 corresponding to the first printing group 51 and the impression point 3 corresponding to the subsequent printing group 53 provides a free space in which the first drying unit, which is an extensive drying unit 61, is installed. This extensive drying unit 61 is dimensioned for providing an exposure time of the web substrate S to the drying agent applied by said extensive drying unit 61 which is at least two times longer, and preferably at least three times longer, than an exposure time of the web substrate S to the drying agent applied by each of the remaining drying units 63, 64, 65, 66, 67, 68, 69.

Longer exposure time of the web substrate S to the drying agent applied by said extensive drying unit 61 entails the possibility of a greater drying capacity for drying the ink applied by the first printing group 51 in relation to the drying capacity of the remaining drying units 63, 64, 65, 66, 67, 68, 69.

Thus, the extensive drying unit 61 located between the first printing group 51 and the subsequent printing group 53 allows using a base ink having a relatively high viscosity, generally white in color, applied by the first printing group 51 as a relatively thick layer completely covering the surface of the web substrate S or a significantly large area thereof, because it assures a sufficient drying of said base ink to allow applying successive inks deposited on top of the base ink by the remaining printing groups 53, 54, 55, 56, 57, 58, 59, 60 without causing the inks to run, even with a high speed of movement of the web substrate S.

The drying units 61, 63, 64, 65, 66, 67, 68, 69 use a drying air stream as the drying agent. To that end, each of the drying units 61, 63, 64, 65, 66, 67, 68, 69, including the extensive drying unit 61, comprises one or more air nozzles (not shown), such as one or more linear air nozzles, for example, blowing drying air on the web substrate S supported on the central impression drum 35, although the extensive drying unit 61 generally comprises a number of air nozzles that clearly exceeds the number of air nozzles included in each of the remaining drying units 63, 64, 65, 66, 67, 68, 69.

The drying air is supplied to the drying units 61, 63, 64, 65, 66, 67, 68, 69, including the extensive drying unit 61, from a drying air supply device (not shown), which includes an air supply turbine taking in ambient air and supplying it as drying air towards the drying units 61, 63, 64, 65, 66, 67, 68, 69 through corresponding conduits (not shown). The drying air supply device preferably includes a heater increasing the temperature of the drying air with respect to the temperature of the ambient air and/or a dehumidifier reducing the humidity of said drying air with respect to the humidity of the ambient air.

In addition to providing a longer exposure time of the web substrate S to the drying agent applied by the extensive drying unit 61, the drying air supply device can include intensive drying elements specific for the extensive drying unit 61, such as a greater drying airflow, a higher drying air temperature or a lower degree of humidity of the drying air with respect to the flow, temperature and degree of humidity of the drying air supplied by the drying air supply device to the remaining drying units 63, 64, 65, 66, 67, 68, 69.

It will be understood that, alternatively, instead of the single extensive drying unit 61 shown in FIG. 1, two or more extensive drying units 61 could be installed with the same result in said free space provided by the angular distance between the impression point 1 corresponding to the first printing group 51 and the impression point 3 corresponding to the subsequent printing group 53.

The printing machine of the first embodiment shown in FIG. 1 further includes a conventional final drying unit 30, for example in the form of a drying tunnel comprising a plurality of air nozzles blowing drying air supplied from the drying air supply device against the web substrate S after the substrate exit point 12 of the central impression drum 35, with respect to the forward movement direction of the web substrate S. This final drying unit 30 performs final drying of all the inks successively deposited on the web substrate S by the different printing groups 51, 53, 54, 55, 56, 57, 58, 59, 60.

In an alternative variant of the embodiment shown in FIG. 1, the drying units 61, 63, 64, 65, 66, 67, 68, 69, including the extensive drying unit 61, use infrared radiation as a drying agent. To that end, each drying unit 61, 63, 64, 65, 66, 67, 68, 69 comprises at least one infrared radiation source. Alternatively, the final drying unit 30 can also use infrared radiation as a drying agent instead of drying air.

FIG. 2 shows a second embodiment of the printing machine having a central impression drum of the present invention, which is similar to the first embodiment described above in relation to FIG. 1, except that in this second embodiment the printing machine comprises five printing groups 51, 52, 53, 54, 55 distributed along the entry side 35*a* and other four printing groups 56, 57, 58, 60 distributed along the exit side 35*b* of the central impression drum 35. The printing groups 51, 52 53, 54, 55, 56, 57, 58, 60 deposit respective water-based inks or solvent-based ink at corresponding impression points 1, 2, 3, 4, 5, 6, 7, 8, 10 on the web substrate S supported on the central impression drum 35.

The printing groups 51, 52, 53, 54, 55, 56, 57, 58, 60 include a first printing group 51 adjacent to said substrate entry point 11 on the entry side 35*a* and a last printing group 60 adjacent to said substrate exit point 12 on the exit side 35*b*.

Between each pair of adjacent printing groups 51, 52; 52, 53; 53, 54; 54, 55; 55, 56; 56, 57; 57, 58; 58, 60, there is arranged a drying unit 61, 62 63, 64, 65, 66, 67, 69 applying a drying agent to the web substrate S supported on the central impression drum 35 for drying the ink deposited on the web substrate S by the preceding printing group by evaporating the water or solvent included in the ink.

Between the impression point 10 corresponding to said last printing group 60 and the impression point 8 corresponding to a preceding printing group 58, there is an angular distance, with respect to the circumference of the central impression drum 35, which is at least two times greater than the angular distance existing between the impression points 1, 2; 2, 3; 3, 4; 4, 5 corresponding to each remaining pair of adjacent printing groups 51, 52; 52, 53; 53, 54; 54, 55 located on the entry side 35*a* of the central impression drum 35 and greater than an angular distance between the impression points 6, 7; 7, 8 corresponding to each remaining pair of adjacent printing groups 56, 57; 57, 58 located on the exit side 35*b* of the central impression drum 35.

Said angular distance between the impression point 10 corresponding to the last printing group 60 and the impression point 8 corresponding to said preceding printing group 58 provides a free space in which the last drying unit, which is an extensive drying unit 69, is installed. This extensive drying unit 69 is dimensioned for providing an exposure time of the web substrate S to the drying agent applied by said extensive drying unit 69 which is at least two times longer, and preferably at least three times longer, than an exposure time of the web substrate S to the drying agent applied by each of the remaining drying units 61, 62, 63, 64, 65, 66, 67.

Longer exposure time of the web substrate S to the drying agent applied by said extensive drying unit 69 entails the possibility of a greater drying capacity for drying the inks successively applied by all the preceding printing groups 51, 52, 53, 54, 55, 56, 57, 58 in relation to the drying capacity of the remaining drying units 61, 62, 63, 64, 65, 66, 67.

Thus, the extensive drying unit 69 located between the last printing group 60 and the preceding printing group 58 allows using a transparent coating varnish or ink, generally having a shiny finish, applied by the last printing group 60 as a layer completely covering the surface of the web substrate or a significantly large area thereof, because it assures a sufficient drying of the inks previously deposited by the remaining printing groups 51, 52, 53, 54, 55, 56, 57, 58 to allow depositing the coating varnish or ink thereon without causing the inks to run, even with a high speed of movement of the web substrate S.

The features of drying units 61, 62, 63, 64, 65, 66, 67, 69, including the extensive drying unit 69, are similar to those described for the drying units 61, 63, 64, 65, 66, 67, 68, 69, including the extensive drying unit 61, of the first embodiment.

The printing machine of the second embodiment shown in FIG. 2 includes a final drying unit 30 having features similar to those described above in relation to the first embodiment.

FIG. 3 shows a third embodiment of the printing machine having a central impression drum of the present invention, which comprises a rotary central impression drum 35 similar to that described above in relation to the first and second embodiments, with four printing groups 51, 53, 54, 55 arranged along the entry side 35*a* of the central impression drum 35 in a manner similar to that described in relation to the first embodiment illustrated in FIG. 1, and other four printing groups 56, 57, 58, 60 arranged along the exit side 35*b* of the central impression drum 35 in a manner similar to that described in relation to the second embodiment illustrated in FIG. 2.

The printing machine of this third embodiment comprises a first extensive drying unit 61 located between the first printing group 51 and the subsequent printing group 53 in a manner similar to that described in relation to the first embodiment illustrated in FIG. 1, a second intensive drying unit 69 located between the last printing group 60 and the preceding printing group 58 in a manner similar to that described in relation to the second embodiment illustrated in FIG. 2, and other five drying units 63, 64, 65, 66, 67 located between each remaining pair of adjacent printing groups 53, 54; 54, 55; 55, 56; 56, 57; 57, 58.

Thus, the first extensive drying unit 61 located between the first printing group 51 and the subsequent printing group 53 allows using a base ink applied by the first printing group 51 as explained above in relation to the first embodiment, and the second extensive drying unit 69 located between the last printing group 60 and the preceding printing group 58 allows using a coating varnish or ink applied by the last printing group 60 as explained above in relation to the second embodiment.

The printing machine of the third embodiment shown in FIG. 3 includes a final curing unit 30 having features similar to those described above in relation to the first embodiment.

The scope of the present invention is defined in the attached claims.

The invention claimed is:

1. A printing machine having a central impression drum, comprising:

a rotary central impression drum (35) having an outer surface suitable for supporting a web substrate (S) between a substrate entry point (11) located on an entry side (35*a*) of said central impression drum (35) and a substrate exit point (12) located on an exit side (35*b*) of the central impression drum (35);

a plurality of printing groups (51-60) distributed along said entry side and said exit side of the central impression drum (35), each printing group (51-60) having a printing cylinder (20) depositing a respective water-based ink or solvent-based ink at a corresponding impression point (1-10) on said web substrate (S) supported on said central impression drum (35), said printing groups (51-60) including a first printing group (51) adjacent to said substrate entry point (11) and a last printing group (60) adjacent to said substrate exit point (12) with respect to the forward movement direction of the web substrate (S); and a plurality of drying units (61-69) configured and arranged for applying a drying agent to the web substrate (S) supported on the central impression drum (35) for drying by evaporating the water or solvent the ink deposited on the web substrate (S), at least one of said drying units (61-69) being arranged between each pair of adjacent printing groups (51-60), wherein:

between the impression point (1) corresponding to said first printing group (51) and the impression point (3) corresponding to a subsequent printing group (53) and/or between the impression point (10) corresponding to said last printing group (60) and the impression point (8) corresponding to a preceding printing group (58) there is an angular distance with respect to the circumference of the central impression drum (35) at least two times greater than an angular distance between the impression points (3-5) corresponding to each remaining pair of adjacent printing groups (53-55) located on said entry side (35*a*) of the central impression drum (35) and than an angular distance between the impression points (6-8) corresponding to each remaining pair of adjacent printing groups (56-58) located on said exit side (35*b*) of the central impression drum (35), wherein the first printing group is the first printing group encountered by the web substrate as the web substrate is conveyed in the conveying direction, and the last printing group is the last printing group encountered by the web substrate as the web substrate is conveyed in the conveying direction; and in a space provided by said angular distance between the impression point (1) corresponding to the first printing group (51) and the impression point (3) corresponding to said subsequent printing group (53) and/or between the impression point (10) corresponding to the last printing group (60) and the impression point (8) corresponding to said preceding printing group (58), there is installed at least one extensive drying unit (61, 69) dimensioned for providing an exposure time of the web substrate (S) to the drying agent applied by said at least one extensive drying unit (61, 69) at least two times longer than an exposure time of the web substrate (S) to the drying agent applied by each of the remaining drying units (63-67).

2. The printing machine according to claim 1, characterized in that said exposure time during which the web substrate (S) is exposed to the drying agent applied by said extensive drying unit (61, 69) is at least three times longer than said exposure time of the web substrate (S) to the drying agent applied by each of the remaining drying units (63-67).

3. The printing machine according to claim 1, wherein each drying unit (61-69) comprises at least one air nozzle blowing drying air supplied from a drying air supply device.

4. The printing machine according to claim 1, further comprising a final drying unit (30) configured and arranged for applying a drying agent to the web substrate (S) after the substrate exit point (12) of the central impression drum (35) with respect to the forward movement direction of the web substrate (S).

5. The printing machine according to claim 4, wherein said final drying unit (30) is a drying tunnel comprising a plurality of air nozzles blowing drying air supplied from a drying air supply device.

6. The printing machine according to claim 3, wherein said drying air supply device includes a dehumidifier reducing the humidity of said drying air with respect to the humidity of the ambient air.

7. The printing machine according to claim 5, wherein said drying air supply device includes a dehumidifier reducing the humidity of said drying air with respect to the humidity of the ambient air.

8. The printing machine according to claim 3, wherein said drying air supply device includes a heater increasing the temperature of said drying air with respect to the temperature of the ambient air.

9. The printing machine according to claim 5, wherein said drying air supply device includes a heater increasing the temperature of said drying air with respect to the temperature of the ambient air.

10. The printing machine according to claim 6, wherein said drying air supply device includes a heater increasing the temperature of said drying air with respect to the temperature of the ambient air.

11. The printing machine according to claim 7, wherein said drying air supply device includes a heater increasing the temperature of said drying air with respect to the temperature of the ambient air.

12. The printing machine according to claim 1, characterized in that each drying unit (61-69) comprises at least one infrared radiation source.

13. The printing machine according to claim 1, characterized in that said printing groups (51-60) are flexographic printing groups, rotogravure printing groups, or offset printing groups, or a combination of flexographic printing groups and/or rotogravure printing groups and/or offset printing groups.

* * * * *